US011226171B2

(12) United States Patent
Sugar

(10) Patent No.: US 11,226,171 B2
(45) Date of Patent: Jan. 18, 2022

(54) DOUBLE-ACTION BAYONET PLATFORM

(71) Applicant: Nathan Sugar, Pueblo, CO (US)

(72) Inventor: Nathan Sugar, Pueblo, CO (US)

( * ) Notice: Subject to any disclaimer, the term of this patent is extended or adjusted under 35 U.S.C. 154(b) by 0 days.

(21) Appl. No.: 17/214,789

(22) Filed: Mar. 26, 2021

(65) Prior Publication Data

US 2021/0302124 A1 Sep. 30, 2021

Related U.S. Application Data

(60) Provisional application No. 63/000,248, filed on Mar. 26, 2020.

(51) Int. Cl.
*F41C 27/18* (2006.01)
*F41A 35/06* (2006.01)
*B26B 1/08* (2006.01)

(52) U.S. Cl.
CPC ..... *F41C 27/18* (2013.01); *B26B 1/08* (2013.01); *F41A 35/06* (2013.01)

(58) Field of Classification Search
CPC ..... F41C 27/16; F41C 27/18; B26B 1/08
See application file for complete search history.

(56) References Cited

U.S. PATENT DOCUMENTS 1,221,616 A 4/1917 Sliwinski
1,240,478 A 9/1917 Nelson
1,260,827 A * 3/1918 Stefanov ..... F41C 27/18 42/86
1,504,073 A * 8/1924 Moore ..... F41C 27/18 30/162
6,968,642 B1 * 11/2005 Leung ..... F41C 23/16 30/162
9,764,485 B1 * 9/2017 Hawk ..... B26B 1/04
10,807,253 B1 * 10/2020 Mandeville ..... B26B 1/08
2008/0222897 A1 * 9/2008 Marfione ..... B26B 1/08 30/162
2012/0255179 A1 * 10/2012 Moizis ..... B26B 1/08 30/162
2014/0215884 A1 8/2014 Adcock, Jr.
(Continued)

FOREIGN PATENT DOCUMENTS

RU 2408831 2/2009

OTHER PUBLICATIONS

Alamy, M16 Rifle with Bayonet, alamy.com.

*Primary Examiner* — Gabriel J. Klein

(57) ABSTRACT

A double-action bayonet platform is an apparatus used to position a rapidly deployable and stowable backup weapon onto a firearm, constituting an improvement upon existing static bayonets. The double-action bayonet platform utilizes a carrier body, a blade member, a blade actuating mechanism, and at least one weapon attachment mechanism to mount an automatically extendable and retractable blade to the fore-end of a rifle as a modular attachment to any weapon accessory rail systems. The at least one weapon attachment mechanism is externally connected to the carrier body to enable the user to attach the carrier body to a weapon. The blade member is slidably mounted into the carrier body and is operably engaged to the blade actuating mechanism. The blade actuating mechanism is configured to bistably traverse between an extended position and a retracted position, enabling a used to rapidly deploy or stow the blade member as needed.

14 Claims, 5 Drawing Sheets

(56) References Cited

U.S. PATENT DOCUMENTS

| | | | | |
|---|---|---|---|---|
| 2014/0338245 | A1* | 11/2014 | Lanasa | F41C 23/16<br>42/72 |
| 2016/0216063 | A1* | 7/2016 | Rockwell | F41C 27/18 |
| 2017/0122699 | A1* | 5/2017 | Badia | F41G 11/003 |
| 2020/0156268 | A1* | 5/2020 | Delplanche | B26B 1/10 |
| 2021/0023725 | A1* | 1/2021 | Buerk | B26B 5/00 |

* cited by examiner

DOUBLE-ACTION BAYONET PLATFORM

The current application claims a priority to the U.S. Provisional Patent application Ser. No. 63/000,248 filed on Mar. 26, 2020.

FIELD OF THE INVENTION

The present invention generally relates to a handheld weapon or tool. More specifically, the present invention relates to an automatic or spring-assisted knife that is mountable to a firearm.

BACKGROUND OF THE INVENTION

A bladed weapon mountable to a firearm is in demand. With time, mounting platforms for firearms have evolved to feature sophisticated configurations and capabilities, with manufacturers having developed a variety of mounting systems, such as the Picatinny rail system, which allows accessories from multiple vendors to be mounted to a combat rifle, so that they are interchangeable among weapons. Such accessories include telescopic sights, range-finding devices, red-dot aiming devices, laser aiming devices, rail-mounted flashlights, alternate sights, and bipods.

However, accessory mounting mechanisms are generally cumbersome and cause delays in mounting and unmounting accessories. For example, a bayonet can be attached to a combat rifle, but the mounting device for attaching such a blade is uncomfortable to manipulate and carrying a firearm with a blade mounted can cause safety issues. Further, the use of a simplified rail-mounted bayonet may impede the use of other accessories, particularly foregrips. Accordingly, there is a need to develop a device that solves these problems.

The present invention is intended to address problems associated with or otherwise improve upon conventional devices through an innovative device that is designed to provide a convenient means of mounting a blade to a firearm while incorporating other problem-solving features.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

Figure 1:
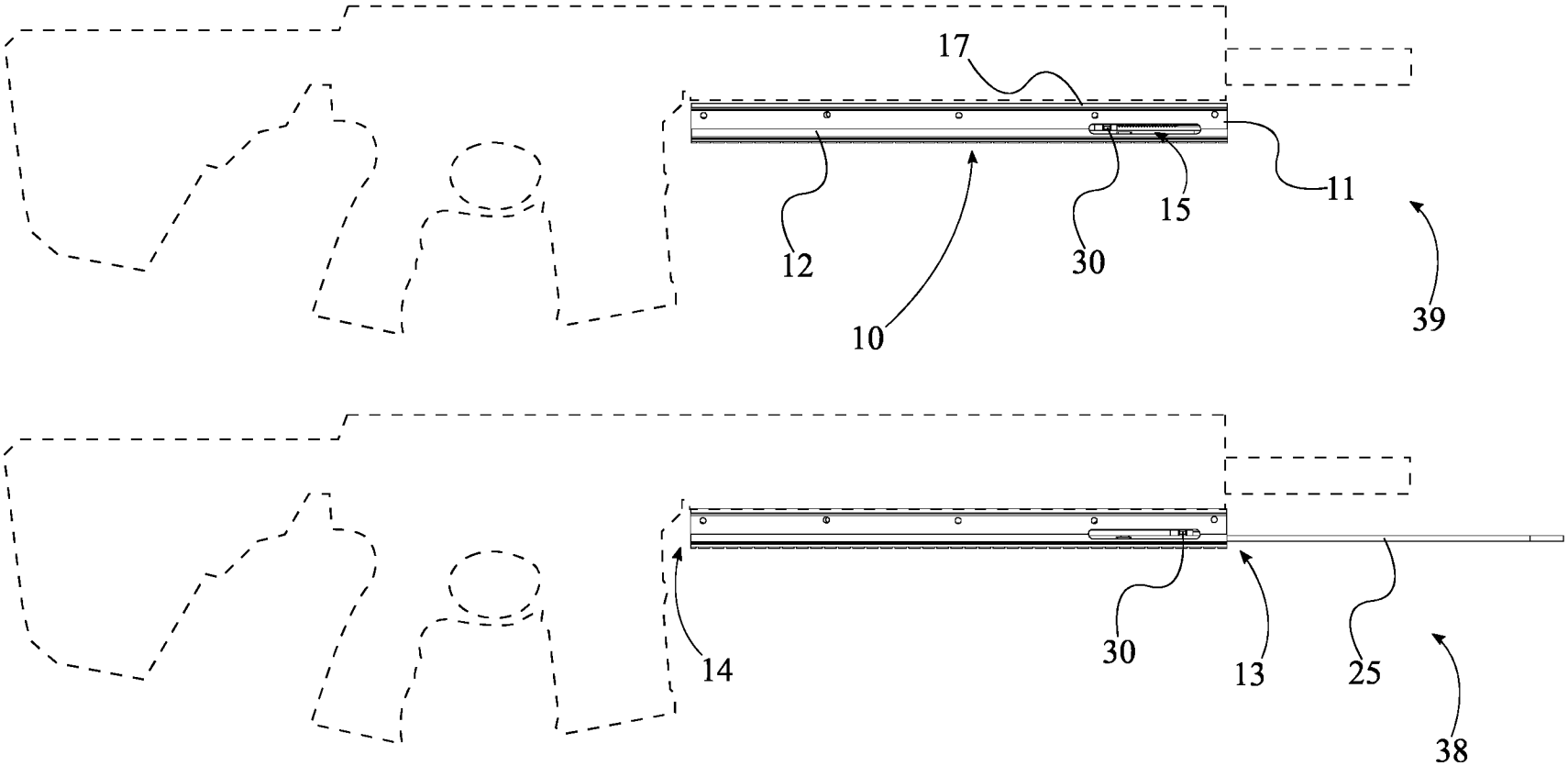
FIG. 1 is an illustration showing one embodiment of the present invention installed on a firearm, wherein a blade member is shown in both an extended position and a retracted position.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIG. 1 through 5, the present invention is a double-action bayonet platform comprising a carrier body 10, a blade member 25, a blade actuating mechanism 21, and at least one weapon attachment mechanism 17. The carrier body 10 defines a ruggedized structural enclosure, ideally suitable for prolonged exposure to harsh conditions without compromising the integrity of the present invention due to shock, moisture, or debris fouling. The blade member 25 preferably defines a knife or other edged weapon, though conceivably the blade member 25 described herein may extend to any type of close-quarters weapon as may be realized by an individual of ordinary skill. The blade actuating mechanism 21 broadly refers to an automatic mechanism suitable for deploying and stowing the blade member 25 under the control of an operator. The at least one weapon attachment mechanism 17 broadly refers to a means of physically mounting the carrier body 10 to a weapon, including any known Rail Integration System (RIS) or other mounting structures typically associated with firearms (i.e., MIL-STD-1913 'Picatinny' rails, VLTOR 'KeyMod', Magpul 'M-LOK', dovetail rails, Weaver rails, any others).

Figure 2:
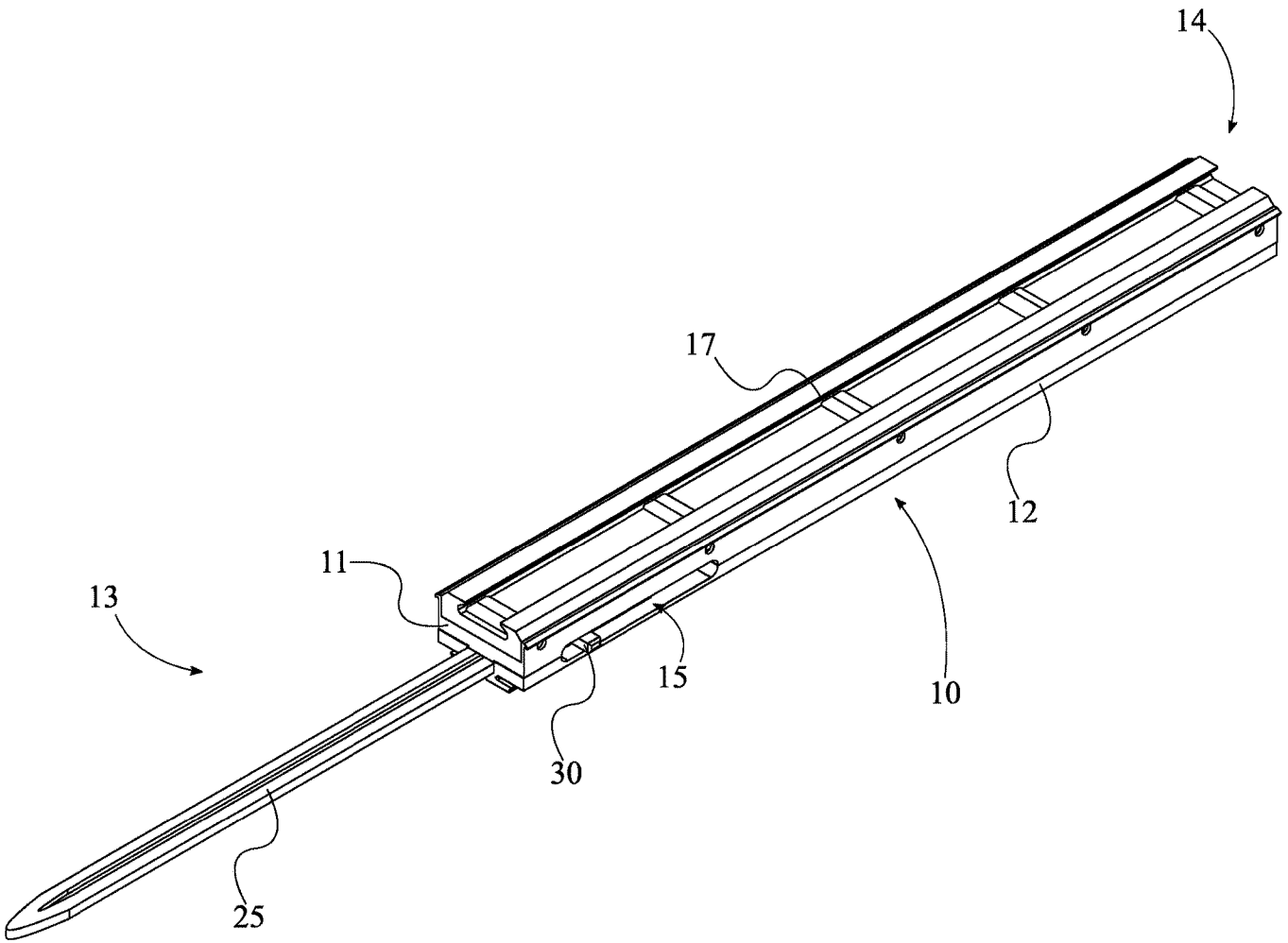
FIG. 2 is a top-front-left perspective view of the present invention, wherein the blade member is shown in the extended position.
Figure 3:
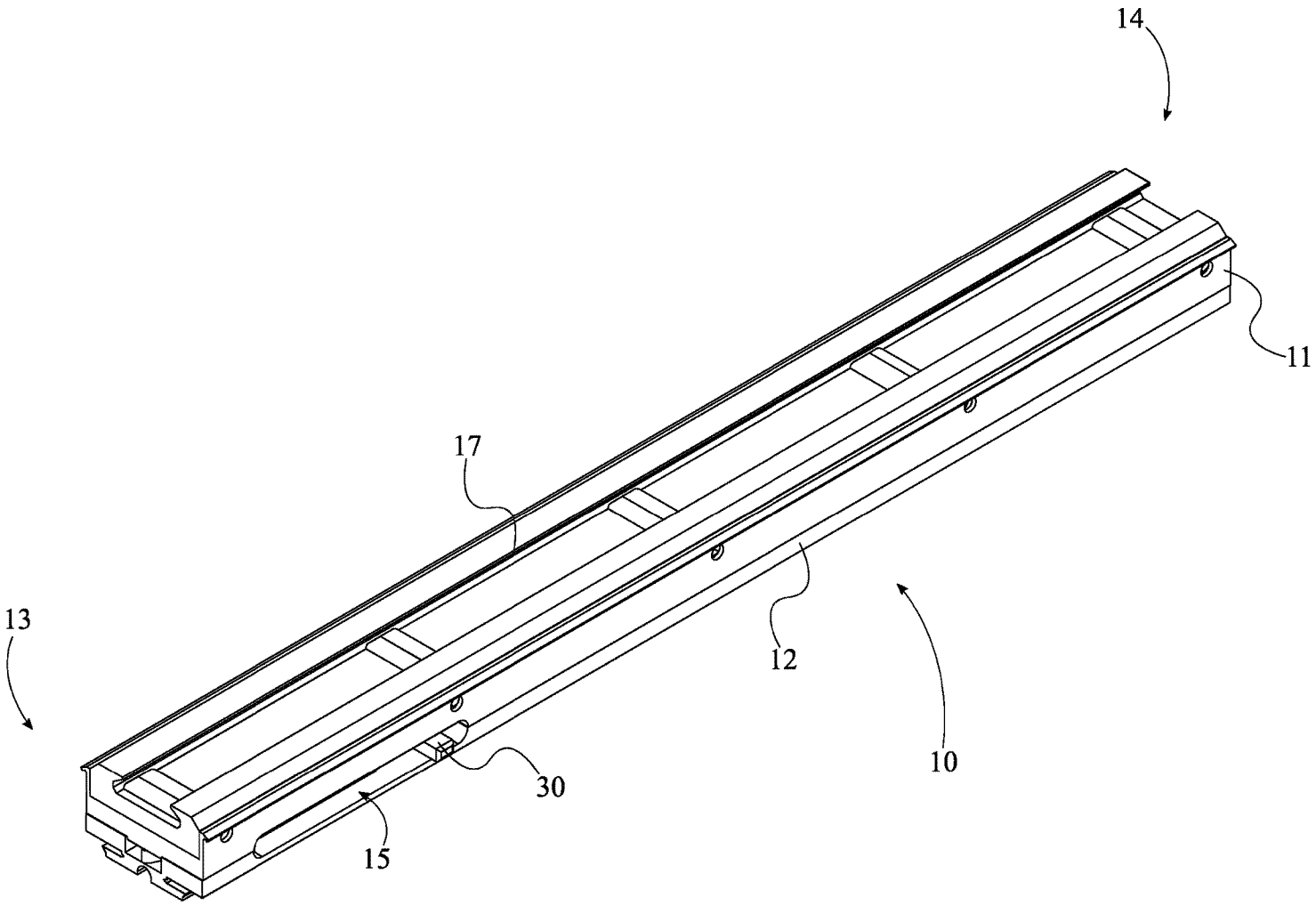
FIG. 3 is a top-front-left perspective view of the present invention, wherein the blade member is shown in the retracted position.

The carrier body 10 extends longitudinally between a distal end 13 and a proximal end 14 to enable the blade member 25 to be substantially enclosed or sheathed when not in use as shown in FIG. 1 through 3. The at least one weapon attachment mechanism 17 is externally connected to the carrier body 10 to allow the carrier body 10 to be attached to a weapon as previously outlined, though it is contemplated that an operator may disengage the at least one weapon attachment mechanism 17 to use the present invention as a hand-weapon in at least one mode of use. The blade member 25 is slidably mounted into the carrier body 10 and is operably engaged to the blade actuating mechanism 21, thereby enabling the blade actuating mechanism 21 to deploy and stow the blade member 25 from within the carrier body 10 without requiring any manual fixation of the blade member 25 to the host weapon (as would be necessary for a conventional bayonet). More specifically, the blade actuating mechanism 21 the blade actuating mechanism is configured to bistably traverse between an extended position 38 and a retracted position 39, wherein the blade member 25 protrudes from the carrier body 10 in the extended position 38 and wherein the blade member 25 is positioned substantially inside the carrier body 10 in the retracted position 39. More specifically, the arrangement of the blade actuating mechanism 21 and the blade member 25 is stable at only two positions—the extended position 38 and the retracted position 39. This functionality is enabled by a consistent tension within the blade actuating mechanism 21, wherein any additional tension introduced to the stable system will cause the blade actuating mechanism 21 to collapse the blade member 25 into the alternate stable position. This additional tension is preferably introduced by an operator manually manipulating the blade actuating mechanism 21. This functionality defines the automatic nature of the present invention, wherein a single activation of the blade actuating mechanism 21 throws the blade member 25 between the extended position 38 and the retracted position 39.

Figure 4:
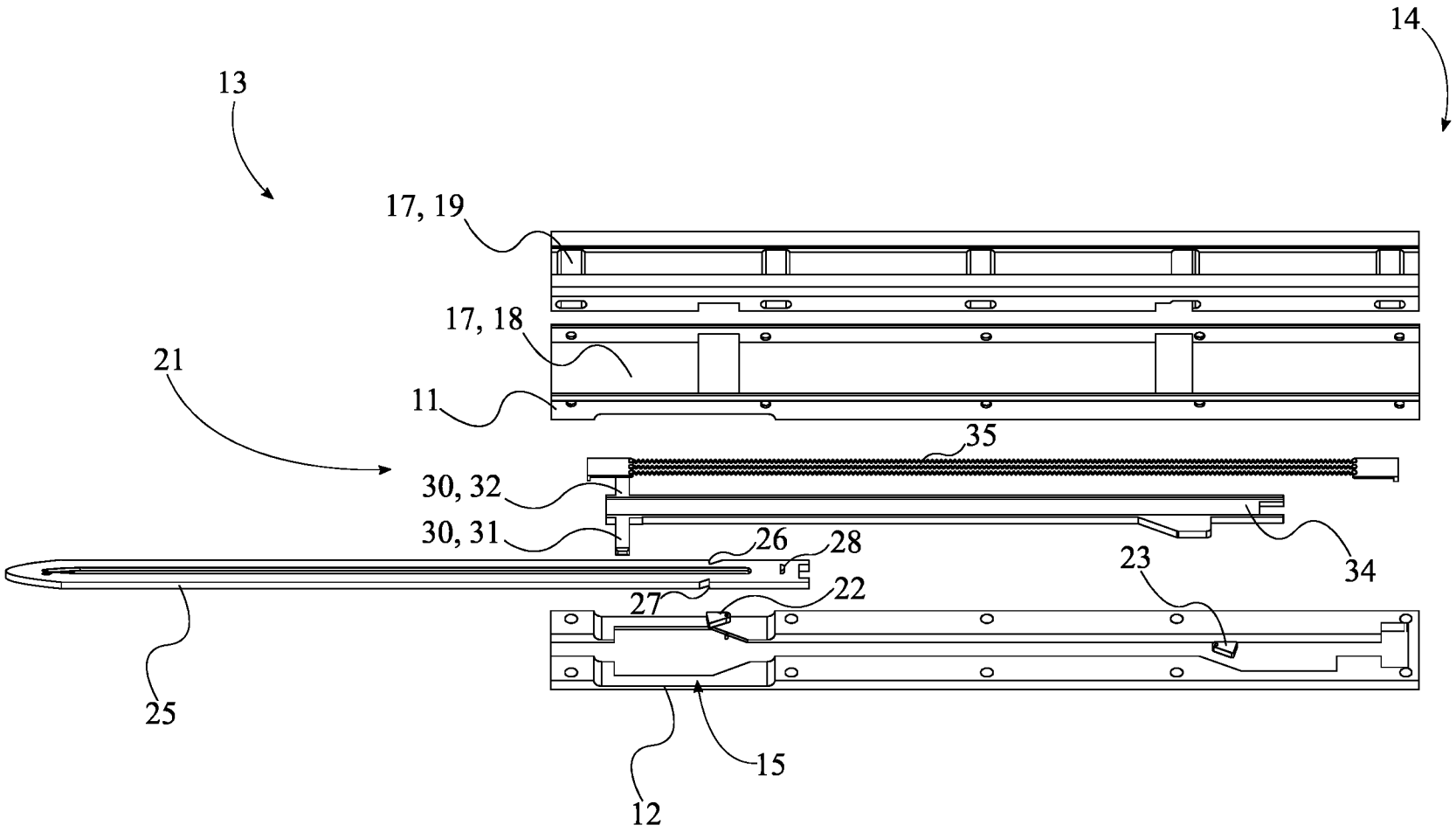
FIG. 4 is a top-left exploded view of the present invention.
Figure 5:
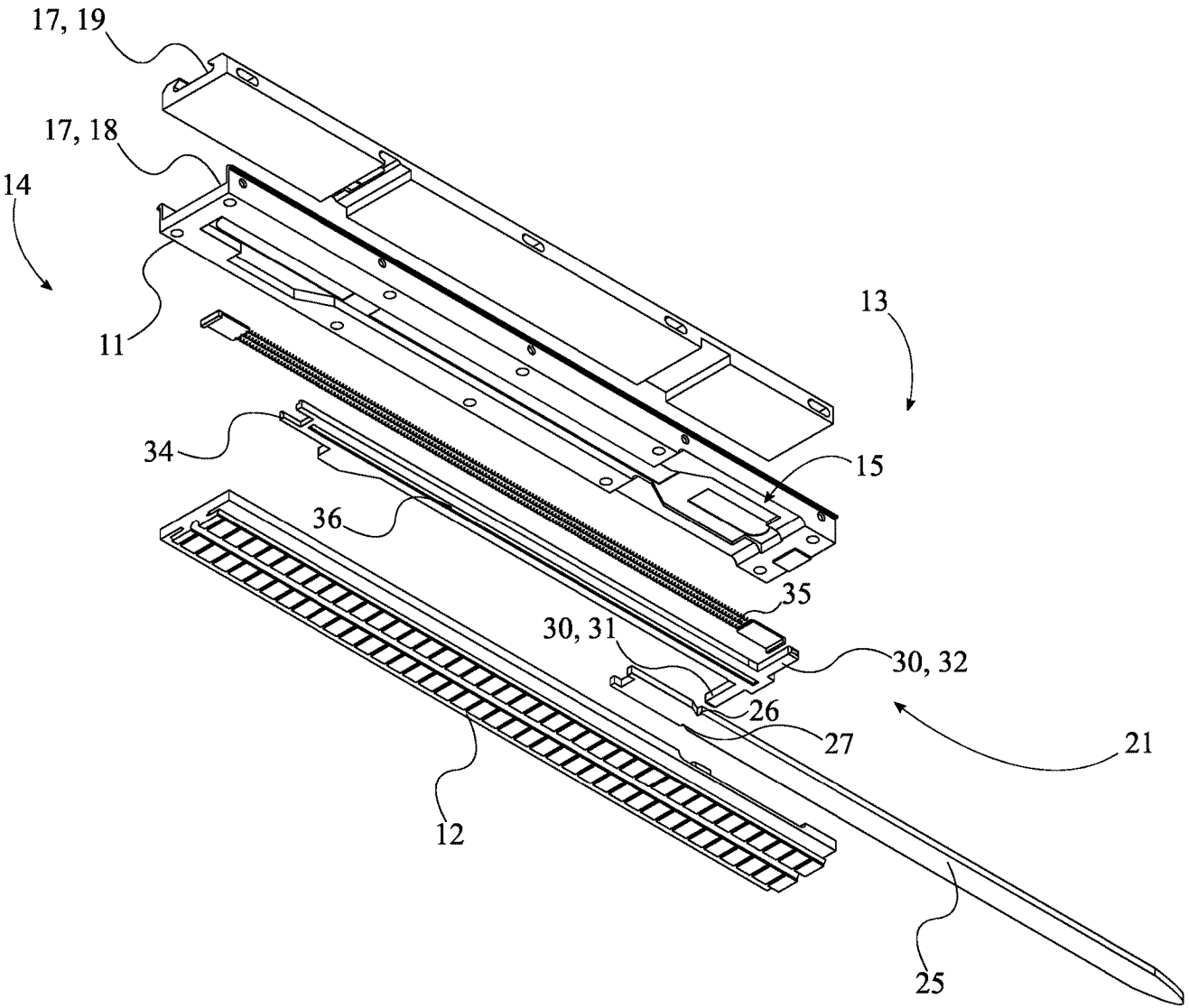
FIG. 5 is a bottom-rear-right exploded view of the present invention.

It is recognized that the proliferation of various weapon mounting systems may cause compatibility issues between various mountable accessories (e.g., a Picatinny-style accessory will not attach to an M-LOK surface and vice versa). Therefore, it is considered that the present invention may be adapted for use with an unlimited variety of accessory rails both as a singular accessory and as an interstitial accessory; constituting an accessory mounted between the firearm and a secondary accessory such as a foregrip or flashlight. In one embodiment, the at least one weapon attachment mechanism 17 further comprises a base mount 18 and a detachable mount 19 as shown in FIGS. 4 and 5, wherein the base mount 18 is externally fixed to the carrier body 10. The base mount 18 ideally defines a quick-detach fastener configured to engage to the detachable mount 19, further enabling the use of the present invention as a convertible standalone hand-weapon when not mounted to a firearm. Accordingly, the detachable mount 19 is releasably fastened to the base mount, opposite the carrier body 10. As shown in FIG. 1, the base mount 18 constitutes an adapter between the firearm-side rail format and the base mount, wherein the base mount 18 rail format may be proprietary. This modular configuration enables the detachable mount 19 to be interchanged to suit varying applications without substantially altering the base mount 18 or the carrier body 10 in general.

To further improve the compatibility of the present invention and enable user-servicing of the moving components, the carrier body 10 comprises an upper carrier 11 and a lower carrier 12 as shown in FIG. 4. The upper carrier 11 and the lower carrier 12 are removably attached between the distal end 13 and the proximal end 14, enabling the blade member 25 and the blade actuating mechanism 21 to be accessed to repair or replace worn or damaged components. Further, proper lubrication of the tolerance surfaces of said components is considered essential to proper function of the blade actuating mechanism 21. Additional benefits are conferred by the separation and exchange of the upper carrier 11 and the lower carrier 12 themselves for alternate configurations of each, whereby a user may configure each instance of the present invention to suit any combination of rail systems as may be required for a given scenario.

In one embodiment shown in FIG. 4, the blade actuating mechanism 21 further comprises a forward sear 22 and a rearward sear 23. The blade member 25 also further comprises a forward notch 26 and a rearward notch 27. As previously outlined, the blade member 25 is positioned between two bistable configurations by the blade actuating mechanism 21 to ensure that the blade member 25 may not fail in a semi-deployed position. Pursuant to these configurations, the forward sear 22 engages into the forward notch 26 to releasably fix the blade member 25 in the extended position 38 and the rearward sear 23 engages into the rearward notch 27 to releasably fix the blade member 25 in the retracted position 39. According to the preferred embodiment of the present invention, the forward sear 22 and the rearward sear 23 define opposed locking pawls extending into the path of the blade member 25 within the carrier body 10. The fixation of the blade member 25 occurs as the blade member 25 reaches the maximal bidirectional extent of travel under force from the blade actuating mechanism 21, alternatively corresponding to the extended position 38 and the retracted position 39. This releasable mechanical fixation ideally prevents the blade member 25 from failing by collapsing under compression when extended or being erroneously extended without input from the operator.

As shown in FIGS. 2 and 3, the blade actuating mechanism 21 comprises at least one hand control 30 to enable the operator to directly operate the blade actuation mechanism. Accordingly, an operating slot 15 traverses into the carrier body 10 with the at least one hand control 30 being operably engaged to the blade actuating mechanism 21 through the operating slot 15. The at least one hand control 30 ideally defines a modular, swappable ergonomic switch or lever suitable for use in the same hazardous environs as the carrier body 10. The operating slot 15 further defines an elongate perforation in the carrier body 10, wherein the operating slot 15 is substantially occupied and sealed by the at least one hand control 30 to prevent the intrusion of debris into the carrier body 10.

In another embodiment, the at least one hand control 30 further comprises a first operating handle 31 and a second operating handle 32. The first operating handle 31 and the second operating handle 32 are positioned laterally opposite from each other along the carrier body 10, wherein the blade actuating mechanism 21 is configured to be operated ambidextrously. This ambidextrous mode of operation expands the utility of the present invention to both left-hand dominant and right-hand dominant shooters. Further, the disposition of the first operating handle 31 and the second operating handle 32 along the carrier body 10 ensures that the present invention cannot be disabled by damage at a single external point of failure.

As illustrated in FIG. 4, the present invention further comprises a trigger plate 34 and at least one spring element 35 in one embodiment. The trigger plate 34 is slidably mounted within the carrier body 10, wherein the trigger plate 34 operably traverses between the distal end 13 and the proximal end 14 of the carrier body 10. The at least one spring element 35 is connected between the trigger plate 34 and the blade member 25, thereby enabling the at least one spring element 35 to continuously draw the blade member 25 towards the trigger plate 34 as the trigger plate 34 traverses within the carrier body 10. Accordingly, the manual manipulation of the trigger plate 34 by an operator moves the blade member 25 between the extended position 38 and the retracted position 39 under force from the at least one spring element 35 as the spring tension overcomes the static position of the blade member 25.

Further, as shown in FIGS. 4 and 5, the blade member 25 further comprises an index pin 28 and the trigger plate 34 further comprises a guide slot 36. The index pin 28 protrudes from the blade member 25 between the distal end 13 and the proximal end 14, and the guide slot 36 traverses the trigger plate 34 between the distal end 13 and the proximal end 14. The index pin 28 is slidably engaged into the guide slot 36, wherein motion of the blade member 25 is limited by impingement of the index pin 28 within the guide slot 36. This arrangement and configuration will reduce the deflection of the blade member 25 within the carrier body 10 by providing an additional linear track coaxial to the axis of motion of the blade actuating mechanism 21. Further, the impingement of the index pin 28 will prevent the blade member 25 from over-extending or over-retracting under force from the at least one spring element 35, ensuring that the blade member 25 accurately assumes one of two bistable positions during all phases of operation.

Although the invention has been explained in relation to its preferred embodiment, it is to be understood that many other possible modifications and variations can be made without departing from the spirit and scope of the invention as hereinafter claimed.

What is claimed is:

1. A double-action bayonet platform comprising:
a carrier body;
a blade member;
a blade actuating mechanism;
at least one weapon attachment mechanism;
the carrier body extending longitudinally between a distal end and a proximal end;
the at least one weapon attachment mechanism being externally connected to the carrier body;
the blade member being slidably mounted into the carrier body;
the blade member being operably engaged to the blade actuating mechanism;
the blade actuating mechanism being configured to bistably traverse between an extended position and a retracted position, wherein the blade member protrudes from the carrier body in the extended position and wherein the blade member is positioned substantially inside the carrier body in the retracted position;
a trigger plate;
at least one spring element;
the trigger plate being slidably mounted within the carrier body, wherein the trigger plate operably traverses between the forward end and the rearward end;
the at least one spring element being connected between the trigger plate and the blade member;
the blade member further comprising an index pin;
the trigger plate further comprising a guide slot;
the index pin protruding from the blade member between the forward end and the rearward end;
the guide slot traversing the trigger plate between the forward end and the rearward end; and
the index pin being slidably engaged into the guide slot, wherein motion of the blade member is limited by impingement of the index pin within the guide slot.

2. A double-action bayonet platform as claimed in claim 1 comprising:
the at least one weapon attachment mechanism comprising a base mount and a detachable mount;
the base mount being externally fixed to the carrier body; and
the detachable mount being releasably fastened to the base mount, opposite the carrier body.

3. A double-action bayonet platform as claimed in claim 1 comprising:
the carrier body comprising an upper carrier and a lower carrier; and
the upper carrier and the lower carrier being removably attached between the forward end and the rearward end.

4. A double-action bayonet platform as claimed in claim 1 comprising:
the blade actuating mechanism further comprising a forward sear and a rearward sear;
the blade member further comprising a forward notch and a rearward notch;
the forward sear engaging into the forward notch to releasably fix the blade member in extended position; and
the rearward sear engaging into the rearward notch to releasably fix the blade member in retracted position.

5. A double-action bayonet platform as claimed in claim 1 comprising:
the blade actuating mechanism comprising at least one hand control;
an operating slot traversing into the carrier body; and
the at least one hand control being operably engaged to the blade actuating mechanism through the operating slot.

6. A double-action bayonet platform as claimed in claim 5 comprising:
the at least one hand control further comprising a first operating handle and a second operating handle; and
the first operating handle and the second operating handle being positioned laterally opposite from each other along the carrier body, wherein the blade actuating mechanism is configured to be operated ambidextrously.

7. A double-action bayonet platform comprising:
a carrier body;
a blade member;
a blade actuating mechanism;
at least one weapon attachment mechanism;
the carrier body extending longitudinally between a distal end and a proximal end;
the at least one weapon attachment mechanism being externally connected to the carrier body;
the blade member being slidably mounted into the carrier body;
the blade member being operably engaged to the blade actuating mechanism;
the blade actuating mechanism being configured to bistably traverse between an extended position and a retracted position, wherein the blade member protrudes from the carrier body in the extended position and wherein the blade member is positioned substantially inside the carrier body in the retracted position;
the at least one weapon attachment mechanism comprising a base mount and a detachable mount;
the base mount being externally fixed to the carrier body;
the detachable mount being releasably fastened to the base mount, opposite the carrier body;
a trigger plate;
at least one spring element;
the trigger plate being slidably mounted within the carrier body, wherein the trigger plate operably traverses between the forward end and the rearward end;
the at least one spring element being connected between the trigger plate and the blade member;
the blade member further comprising an index pin;
the trigger plate further comprising a guide slot;
the index pin protruding from the blade member between the forward end and the rearward end;
the guide slot traversing the trigger plate between the forward end and the rearward end; and
the index pin being slidably engaged into the guide slot, wherein motion of the blade member is limited by impingement of the index pin within the guide slot.

8. A double-action bayonet platform as claimed in claim 7 comprising:
the carrier body comprising an upper carrier and a lower carrier; and the upper carrier and the lower carrier being removably attached between the forward end and the rearward end.

9. A double-action bayonet platform as claimed in claim 7 comprising:

the blade actuating mechanism further comprising a forward sear and a rearward sear;

the blade member further comprising a forward notch and a rearward notch;

the forward sear engaging into the forward notch to releasably fix the blade member in extended position; and the rearward sear engaging into the rearward notch to releasably fix the blade member in retracted position.

10. A double-action bayonet platform as claimed in claim 7 comprising:

the blade actuating mechanism comprising at least one hand control;

an operating slot traversing into the carrier body; and the at least one hand control being operably engaged to the blade actuating mechanism through the operating slot.

11. A double-action bayonet platform as claimed in claim 10 comprising:

the at least one hand control further comprising a first operating handle and a second operating handle; and the first operating handle and the second operating handle being positioned laterally opposite from each other along the carrier body, wherein the blade actuating mechanism is configured to be operated ambidextrously.

12. A double-action bayonet platform comprising:

a carrier body;

a blade member;

a blade actuating mechanism;

at least one weapon attachment mechanism;

the carrier body extending longitudinally between a distal end and a proximal end;

the at least one weapon attachment mechanism being externally connected to the carrier body;

the blade member being slidably mounted into the carrier body;

the blade member being operably engaged to the blade actuating mechanism;

the blade actuating mechanism being configured to bistably traverse between an extended position and a retracted position, wherein the blade member protrudes from the carrier body in the extended position and wherein the blade member is positioned substantially inside the carrier body in the retracted position;

the at least one weapon attachment mechanism comprising a base mount and a detachable mount;

the base mount being externally fixed to the carrier body;

the detachable mount being releasably fastened to the base mount, opposite the carrier body;

the blade actuating mechanism comprising at least one hand control;

an operating slot traversing into the carrier body;

the at least one hand control being operably engaged to the blade actuating mechanism through the operating slot;

the carrier body comprising an upper carrier and a lower carrier;

the upper carrier and the lower carrier being removably attached between the forward end and the rearward end;

a trigger plate;

at least one spring element;

the trigger plate being slidably mounted within the carrier body, wherein the trigger plate operably traverses between the forward end and the rearward end;

the at least one spring element being connected between the trigger plate and the blade member;

the blade member further comprising an index pin;

the trigger plate further comprising a guide slot;

the index pin protruding from the blade member between the forward end and the rearward end;

the guide slot traversing the trigger plate between the forward end and the rearward end; and the index pin being slidably engaged into the guide slot, wherein motion of the blade member is limited by impingement of the index pin within the guide slot.

13. A double-action bayonet platform as claimed in claim 12 comprising:

the blade actuating mechanism further comprising a forward sear and a rearward sear;

the blade member further comprising a forward notch and a rearward notch;

the forward sear engaging into the forward notch to releasably fix the blade member in extended position; and the rearward sear engaging into the rearward notch to releasably fix the blade member in retracted position.

14. A double-action bayonet platform as claimed in claim 12 comprising:

the at least one hand control further comprising a first operating handle and a second operating handle; and the first operating handle and the second operating handle being positioned laterally opposite from each other along the carrier body, wherein the blade actuating mechanism is configured to be operated ambidextrously.

* * * * *